US007481015B2

(12) United States Patent
Mays

(10) Patent No.: US 7,481,015 B2
(45) Date of Patent: Jan. 27, 2009

(54) RAMROD FOR WIPING BORE RESIDUE, LUBRICATING AND LOADING MUZZLELOADERS

(75) Inventor: Gerald William Mays, Leslie, MI (US)

(73) Assignee: Gerald W. Mays, Leslie, MI (US)

( * ) Notice: Subject to any disclaimer, the term of this patent is extended or adjusted under 35 U.S.C. 154(b) by 206 days.

(21) Appl. No.: 11/277,751

(22) Filed: Mar. 28, 2006

(65) Prior Publication Data

US 2007/0294930 A1 Dec. 27, 2007

(51) Int. Cl.
*F41C 9/08* (2006.01)

(52) U.S. Cl. ..... 42/51

(58) Field of Classification Search ..... 42/51, 42/95

See application file for complete search history.

(56) References Cited

U.S. PATENT DOCUMENTS

| | | | | | |
|---|---|---|---|---|---|
| 480,746 | A * | 8/1892 | Sandberg | 428/377 |
| 1,450,037 | A * | 3/1923 | Heiman | 15/104.16 |
| 1,526,177 | A * | 2/1925 | Olberding | 15/104.16 |
| 2,559,376 | A * | 7/1951 | Schnitger | 15/104.05 |
| 2,862,218 | A * | 12/1958 | Krone | 15/104.16 |
| 3,208,302 | A * | 9/1965 | Lewis et al. | 74/548 |
| 3,536,160 | A * | 10/1970 | Brewer | 184/109 |
| 4,254,572 | A * | 3/1981 | Nelson | 42/90 |
| 4,497,082 | A * | 2/1985 | Kogasaka | 15/104.165 |
| 4,499,625 | A * | 2/1985 | Bottomley | 15/104.165 |
| 4,813,169 | A * | 3/1989 | Calliebe | 42/90 |
| 4,858,360 | A * | 8/1989 | Hardin | 42/95 |
| 4,866,871 | A * | 9/1989 | Rivers | 42/95 |
| 4,873,778 | A * | 10/1989 | Stipp | 42/95 |
| 4,901,464 | A * | 2/1990 | Banoun | 42/95 |
| 4,901,465 | A * | 2/1990 | Hsu | 42/95 |
| 5,337,505 | A * | 8/1994 | Brown et al. | 42/95 |
| 5,628,136 | A * | 5/1997 | Wickser, Jr. | 42/95 |
| 5,651,207 | A * | 7/1997 | Knight | 42/95 |
| 5,657,570 | A * | 8/1997 | Sigier Emmanuel | 42/95 |
| 5,934,000 | A * | 8/1999 | Hayes, Sr. | 42/95 |
| 5,946,843 | A * | 9/1999 | Paananen | 42/95 |
| 6,145,235 | A * | 11/2000 | Emerson et al. | 42/90 |
| RE38,247 | E * | 9/2003 | Wickser, Jr. | 42/95 |
| 6,691,446 | B2 * | 2/2004 | Graves | 42/95 |

* cited by examiner

*Primary Examiner*—Bret Hayes

(57) ABSTRACT

A device for a bore wiping, self-lubricating ramrod used for muzzle loading gun barrels. The device consists of a bullet jag with two O-rings, and a center hole to allow the lubricant to get into the bore. As the jag is passed down the bore a small amount of lubricant is released into the bore. The first O-ring stops the lubricant from leaving the bore, and the second O-ring wipes the bore clean when the ramrod is pulled out of the bore. The ramrod may be made in different diameters to accommodate different caliber muzzleloaders. The shooter uses the same ramrod for lubing and loading the weapon with the same pass down the barrel.

5 Claims, 2 Drawing Sheets

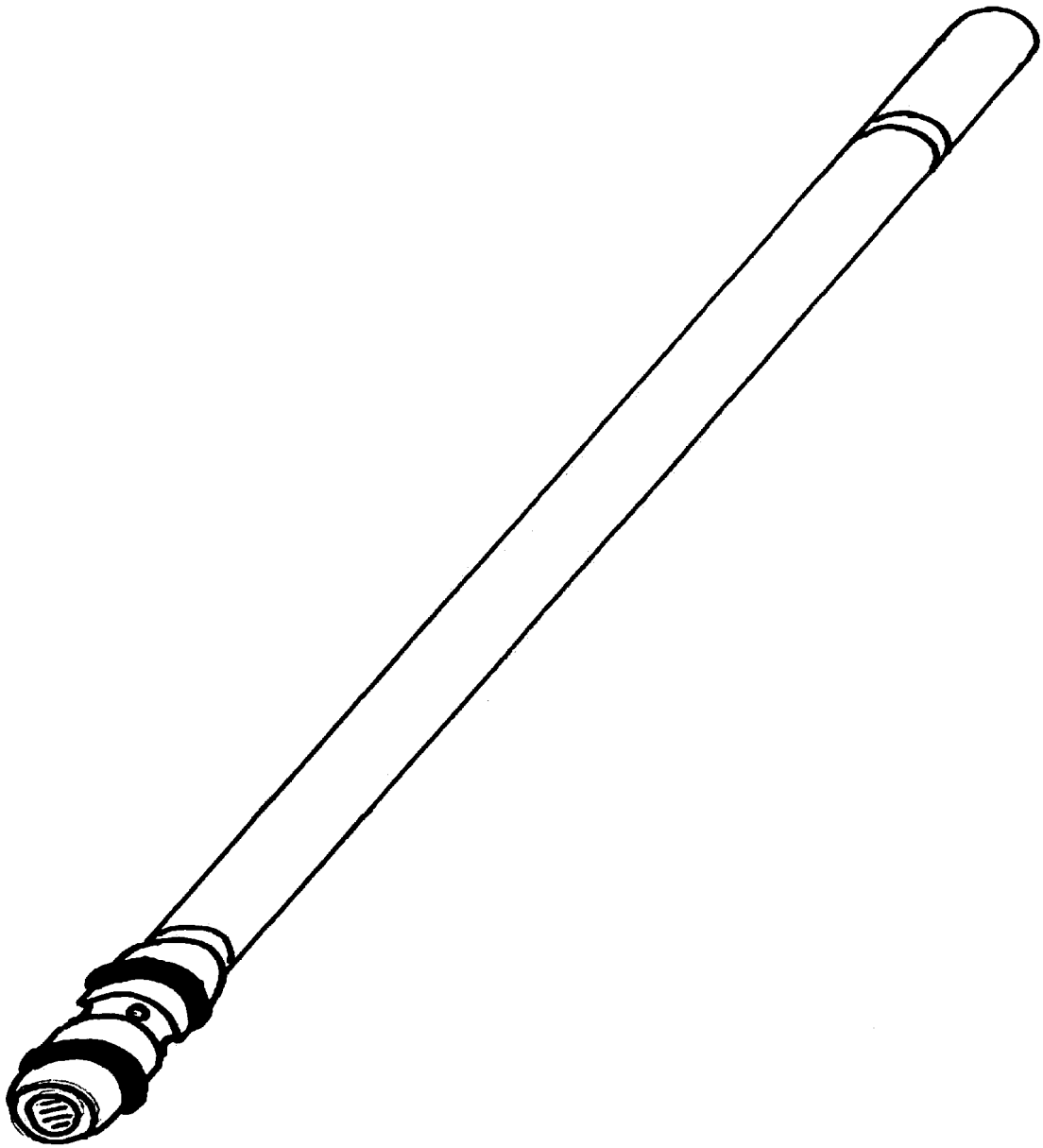
Figure #1

Figure #2
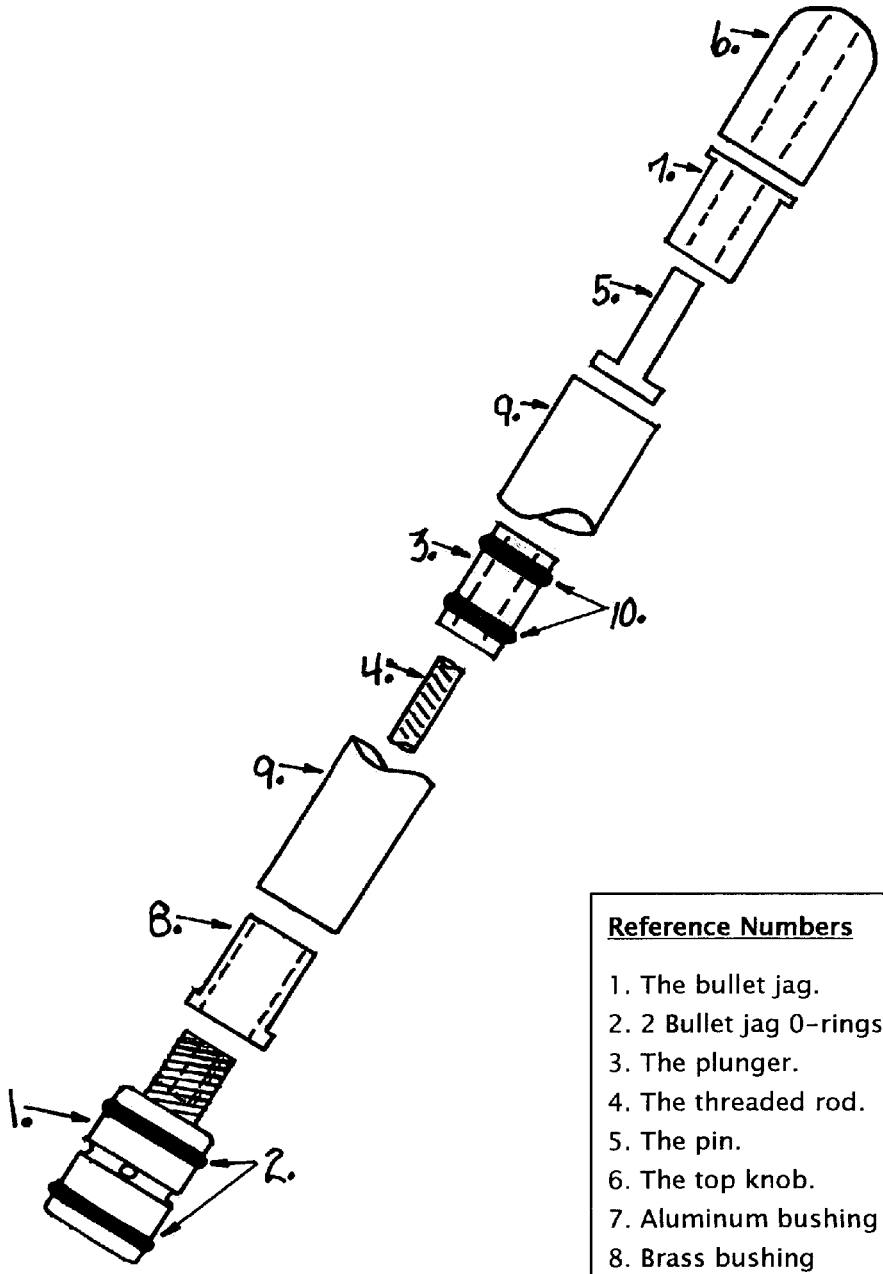
Reference Numbers
1. The bullet jag.
2. 2 Bullet jag 0-rings.
3. The plunger.
4. The threaded rod.
5. The pin.
6. The top knob.
7. Aluminum bushing
8. Brass bushing
9. The brass tubing.
10. 2 Plunger 0-rings

RAMROD FOR WIPING BORE RESIDUE, LUBRICATING AND LOADING MUZZLELOADERS

BACKGROUND

1. Field of Invention

At this first patent this invention relates to the removal of residue and burning material from a muzzle loading, black powder gun and the lubricating of the bore as well as the loading of the gun after each shot in order to keep the gun shooting a straight and smooth shot. There is also interest in adapting the boreswipe for cleaning tubing, large and small, modern day weapon barrels including but not limited to revolvers, rifles, shotguns, and larger military weapons. Also, it could be used in the field of science and medical equipment.

2. Description of Prior Art

Muzzleloaders are any firearms into which the bullet is loaded from the muzzle of the gun. It could be anything from a pistol to a cannon, but in our modern times it generally refers to black powder small arms.

The shooter puts in gunpowder (a pre-measured pellet, loose powder or a pre-measured bag), adds wadding (soft material like cloth), and the projectile (usually a solid lead ball). Because the items are generally tight fitting, and the barrel is long, a tool called a ramrod is used to push the items down.

Muzzleloaders must be cleaned each time, or at least every several shots, to remove the burning material left in the barrel, and the residue left from black powder. This residue reduces the interior bore diameter of the barrel causing subsequent powder pressures to increase. Without removing at least some of this residue, each shot becomes increasingly harder to load, and less accurate to shoot. To correct this build-up muzzleloaders must wipe the inside of the bore after no more than 5 shots. If this is not done it will become impossible to drive the ball down the barrel completely without badly deforming the soft lead creating a dangerous condition in which the barrel may burst.

One of the earliest muzzle loading guns was developed in the 15th century. It was a small hand cannon with a touch hole for ignition. It was unsteady, unreliable, and had to be propped on something to shoot it. It was only effective for about 30 yards. The first muzzle loader improvement was the invention of the flash pan—a cup by the touch hole that could be more easily ignited. Unfortunately, it suffered from any moisture and bad weather. The next step in muzzle loading evolution was the wheel lock, a device something like a modern lighter with a flint pressed against a rough wheel to create sparks and ignite the gunpowder. It worked better but was expensive to make. Eventually technology arrived at the flintlock, where the striking surface and flash pan cover were all one piece. This made the mechanism simpler and less expensive to produce. It also allowed more creative gun designs that could be made small enough to conceal. This design was the basis for the Brown Bess Flintlock in the early 1700's, a gun that was instrumental in settling the new frontier of America. They were quite accurate—to about 80 yards. The design also let a practiced shooter load and fire up to three rounds per minute.

The percussion cap ignition system was developed in 1805 and eliminated any exposed powder and the flash pan. The explosive cap was placed on top of a small tube that allowed the flames from the exploding fulminate of mercury to enter the barrel and ignite the powder that propelled the bullet. This mechanism was a major advance in reliability and was virtually immune to moisture unless water got into the barrel. The design was also the basis for developing revolvers.

All of the inventions to this date, to improve the performance and reliability of the muzzleloader have centered on the ignition mechanism, the powder, and the barrel. While much forward progress has been made, no one has addressed the problem of cleaning and lubing the bore between shots as needed for greater accuracy. No one has made any significant change in the ramrod.

Up to now the ramrods have been made out of a variety of materials including wood, solid brass, steel, glass-reinforced polymer and aluminum—for example, U.S. Pat. No. 4,890,406; U.S. Pat. No. 480,746, U.S. Pat. No. 4,890,406, and U.S. Pat. No. 480,746. None have been made with a hollow center for the use of holding a lube that will lubricate the inside of the bore when loading thus keeping the bore clear of built up residue and lubricating the it so that the ball will sided into the bore easily.

An avid hunter and shooter with an engineering and machinist background, Gerald (Jerry) Mays attempted to solve the problem of wiping and lubing the bore of a muzzle loader at the same time it was being loaded, for more uniform accuracy of each shot, in a simplified, easy to use, and cleaner manner.

In the fall of 2004, Jerry rough sketched a proposed ramrod with an internal lubricant. He located some brass tubing and built a prototype. One of the first attempts used the hollow shaft from an arrow for the ramrod. Several were made and used by friends for some informal evaluation. Refinements in the materials used, such as a stiffer rod, improved bushings, and the development of lubricant by his sister, Judith Somers, led Jerry to file for a Provisional Patent: U.S. Provisional Patent No. 60/686,997

OBJECTS AND ADVANTAGES (a) One ramrod is needed for removing residue, lubricating and loading a muzzle loading gun.

(b) Nothing can be left in the bore like a patch or swab.

(c) Lube can be loaded into the ramrod once for an entire shooting session.

(d) Residue is removed after each shot creating a smooth bore for shooting.

SUMMARY

Muzzle loaders are any firearms into which the bullet is loaded from the muzzle of the gun.

It could be anything from a pistol to a cannon, but in our modern times it generally refers to black powder small arms.

This ramrod is a new way to wipe powder residue and built up burning material from the bore and lube a muzzleloader barrel at the same time the shooter is reloading for the next shot. The ramrod may be made in different diameters and different lengths to accommodate different caliber muzzleloaders.

This ramrod allows the shooter to have one ramrod that can be used for several purposes. One of those purposes is to remove the built up burning material and residue left behind after shooting a muzzle loading gun using black powder. Another purpose is to be able to remove that residue at the line of shooting along with lubricating the bore keeping it clear and smooth for the ball (bullet) to be inserted. This purposes combine allow the shooter one tool to carry instead of several that have been used in the past. For example: a solid ramrod for loading the ball as in U.S. Pat. No. 4,813,169; a bullet lubricator as in U.S. Pat. No. 4,254,572; a cleaning rod as in U.S. Pat. No. 3,208,302; a cleaning jag as in U.S. Pat. No. 5,651,207.

All ramrod's made up to this date have been made of solid materials as in as in U.S. Pat. No. 480,746. Others have different brushes and devices fitted on the end of a solid rod to remove the residue. Yet others have tried to remove the residue using various residue dissolving oils as in U.S. Pat. No. 3,536,160.

As our search concludes no ramrod has been invented that is hollow with a plunger that as the end of the ramrod is turned the lube comes out at the end of the ramrod that goes into the bore of the gun. Then on retrieval it removes the left over residue and burning material that is left from the use of the black powder. Then can be easily carried in the original mounting on the gun and used after each shot.

BRIEF DESCRIPTION OF THE DRAWINGS

FIG. 1 is an assembled view of the present invention; And, FIG. 2 is an exploded view of the present invention.

DETAILED DESCRIPTION

This device is a ramrod for wiping powder residue from the bore, and lubricating and loading muzzle loading gun barrels. It consists of 8 metal parts and 4 rubber O-rings.

REFERENCE NUMERALS

1. The bullet jag. The jag is attached to a bushing, which is soldered to the ramrod. The bullet jag has three grooves cut into it. The first contains an O-ring that stops the lubricant from exiting the bore when the ramrod is inserted into the bore. The second groove has two holes to allow the lubricant to be distributed into the bore as the ramrod is pushed down the bore. The third groove has an O-ring to wipe the bore clean of lubricant when the ramrod is extracted. The jag can be made in different diameters for different caliber muzzleloaders.

2. 2 Bullet jag O-rings. The O-rings used may be in different diameters to accommodate different calibers of muzzleloaders.

3. The plunger. The plunger is attached to a threaded rod allowing it to move up and down the inside of the ramrod to dispense the lubricant into the bullet jag. Two O-rings on the plunger force the lubricant down into the jag and out into the barrel.

4. The threaded rod. A threaded rod moves the plunger up and down the inside of the ramrod as lubricant is dispensed. The threaded rod is attached to the plunger and to the top bushing.

5. The pin. The pin is inserted into an aluminum bushing and that bushing is hot glued into the brass ramrod and crimped.

6. The top knob. The top knob is soldered to the pin (#5), which is inserted into the aluminum bushing. The knob is threaded to the rod (#4), and the rod is threaded through the plunger.

7. Aluminum bushing.

8. Brass bushing.

9. The brass tubing. The outer brass tubing holds the top bushing, the threaded rod, plunger, and the bottom bushing and bullet jag. The tubing is made of brass so that it will not damage the crown of the muzzle and therefore can be safely used for loading.

10. 2 Plunger O-rings. Two O-rings on the plunger push lubricant into the bullet jag.

Operation

CONCLUSION, RAMIFICATIONS, AND SCOPE

This ramrod can certainly change the speed at which a shooter can clear his muzzle loading gun bore between shots. It will also allow less equipment that will have to be pack on the hunt or to the range. It will keep the hands clean as the hands do not have to touch the residue or the black burning material that is left on the ramrod as it can be wiped clean with a small cloth. It most definitely help to keep the bore free of excess residue so that each shot will be a straight and sure as the first one fired.

I claim:

1. A lubricating tool for rifle bores comprising:

a tool with a hollow longitudinal bore;

a removable external bullet jag at a first end of the tool allowing the hollow longitudinal bore to be filled with lubricant and comprising an internal passageway with dual outlets to release lubricant into rifle bores;

a moveable internal plunger including two o-rings configured to force lubricant through the external jag into rifle bores;

a threaded rod connected to the internal plunger configured to drive the internal plunger through the longitudinal bore;

whereby when the internal plunger is moved away from the external jag, the tool is configured to be filled with lubricant, and when the internal plunger is moved toward the external jag, the tool is configured to dispense lubricant into rifle bores;

a top knob at a second end of the longitudinal bore configured to turn the threaded rod which moves the internal plunger through the hollow longitudinal bore of the tool for filling the tool with lubricant or dispensing lubricant into rifle bores.

2. The lubricating tool of claim 1, wherein the external jag further includes a first o-ring on a lower end thereof and a second o-ring on an upper end thereof;

wherein rotation of the top knob in a first direction facilitates filling the tool with lubricant and rotation in a second direction opposite the first direction facilitates dispensing lubricant into rifle bores, the lubricant dispensing above the first o-ring to soften residue; and, wherein removal of the tool from a rifle bore brings residue out of the rifle bore and leaves the rifle bore substantially clean and lubricated.

3. The lubricating tool of claim 1, further configured to seat a bullet into a substantially cleaned and lubricated rifle bore to ensure successive shots will be accurate and uniform and to allow a cleaned and lubricated rifle bore to be used multiple times before a full cleaning of the rifle bore is necessary.

4. The lubricating tool of claim 1, wherein an overall length of the tool can be made to accommodate barrel lengths of various rifle bores.

5. The lubricating tool of claim 1, wherein a diameter of the external jag can be made to accommodate calibers of various rifle bores.

* * * * *